US007770495B1

(12) United States Patent
Huang

(10) Patent No.: US 7,770,495 B1
(45) Date of Patent: Aug. 10, 2010

(54) RATCHET CONNECTOR

(76) Inventor: Ping-Wen Huang, No. 5, Alley 24, Lane 247, Sinyi St., Wurih Township (TW) 414

( * ) Notice: Subject to any disclaimer, the term of this patent is extended or adjusted under 35 U.S.C. 154(b) by 22 days.

(21) Appl. No.: 12/366,847

(22) Filed: Feb. 6, 2009

(51) Int. Cl.
*B25B 13/46* (2006.01)
*B25B 23/16* (2006.01)

(52) U.S. Cl. ..... 81/63.1; 81/177.5; 81/177.7

(58) Field of Classification Search ..... 81/60–63.2, 81/177.8, 177.5, 177.7
See application file for complete search history.

(56) References Cited

U.S. PATENT DOCUMENTS 3,127,799 A * 4/1964 Bergquist ..... 81/62
7,331,258 B1 * 2/2008 Hsieh ..... 81/63
7,434,493 B2 * 10/2008 Huang ..... 81/63.1
2004/0129114 A1 * 7/2004 Chen ..... 81/63
2009/0193944 A1 * 8/2009 Yang ..... 81/63.2

* cited by examiner

*Primary Examiner*—Hadi Shakeri
(74) *Attorney, Agent, or Firm*—Wang Law Firm; Li K. Wang

(57) ABSTRACT

A ratchet connector includes a driving element, a control ring, and a working element. A tooth block is disposed in an open groove of the driving element. Both sides of the tooth block have several teeth. The control ring is mounted on the driving element to control the tooth block to move along the bottom of the open groove. The working element is mounted on the driving element. The teeth of the tooth block engage with the ratchet teeth on an inner surface of the working element.

8 Claims, 11 Drawing Sheets

RATCHET CONNECTOR

BACKGROUND OF THE INVENTION

1. Field of Invention

The invention relates to a ratchet connector and, in particular, to a ratchet connector with large torque and easy to change its orientation.

2. Related Art

Please refer to FIG. 11, which shows a conventional ratchet connector. The hexagonal base 72 of a supporter 71 is inserted in the mounting hole of a box end wrench. The O-ring 73 of the hexagonal base 72 urges against the inner wall of the mounting hole in a resilient way. The supporter 71 is positioned at the box end wrench.

However, when the user exerts a force on the box end wrench, it often departs from the hexagonal base 72. This is very troublesome.

Besides, flipping the change orientation switch 74 on the side edge of the supporter 71 can change the screw driving direction to clockwise or counterclockwise. However, the change orientation switch 74 is located on one side edge of the supporter 71. Therefore, the user can only operate in a single direction. It is thus very inconvenient. Moreover, the change orientation switch 74 is often mis-triggered in practice. This is the most serious problem of the ratchet connector.

Please refer to FIGS. 12 and 13. They show another conventional ratchet connector. It uses a switch ring 81 to change the screw driving direction. This solves the problem of operating the change orientation switch 74 in a single direction in FIG. 11. In particular, a first latch 82 and a third latch 83 are limited in an accommodating groove 84 by the switch ring 81. A second latch 85 and a fourth latch 86 go into a latch groove 87, respectively. A ratchet 88 is only allowed to rotate in one direction. To rotate the ratchet 88 in the opposite direction, one rotates the switch ring 81 so that the second latch 85 and the fourth latch 86 are retracted by the switch ring 81 into the accommodating groove 84. The first latch 82 and the third latch 83 go into the corresponding latch grooves 87.

Although the switch ring 81 improves the drawback of triggering by mistake, the control is not accurate. When the user rotates the switch ring 81 to change the rotating direction of the ratchet 88, it is often not smooth because the structures of the latches 82, 83, 85, 86 are not perfect. This is the problem of this design. Due to the consideration of torque, this design requires at least four latches. This makes the manufacturing process complicated and expensive.

Please refer to FIG. 14 for a third conventional ratchet connector. A knob 91 is screwed onto a driving section 92 to solve the problem that the box end wrench 93 may easily fall off the driving section 92. However, in practice, the user has to first release the knob 91, dispose the box end wrench 93, and then tighten the knob 91 to position the box end wrench 93. The knob 91 is convenient for operations and thus needs to improve.

SUMMARY OF THE INVENTION

An objective of the invention is to provide a ratchet connector that uses a control ring to rotate and change the driving direction. An elastic element in the control ring urges against the guiding surface of a tooth block. The tooth block can move smoothly. Therefore, the user can readily change the driving direction.

Another objective of the invention is to use the restriction of a single tooth block by the protruding part of an open groove to increase the stopping force thereof. In addition to provide large torques, the invention can simplify the manufacturing process and reduce the material cost.

A further objective of the invention is to provide a ratchet connector with a quick positioning hand tool. A positioning element or knob is disposed at the driving end of the ratchet connector to quickly and firmly position the box end wrench or open wrench.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
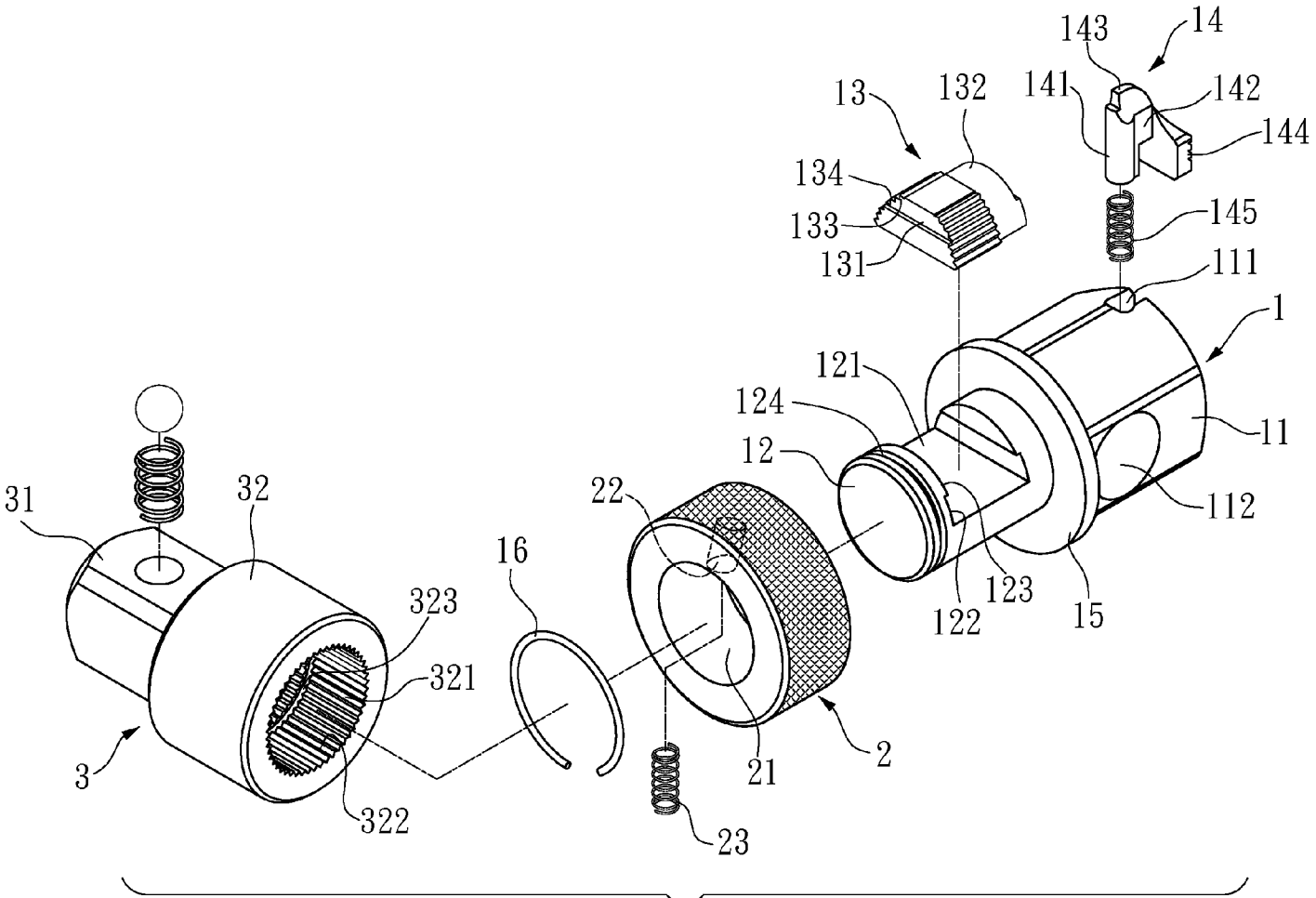
FIG. 1 is a three-dimensional exploded view of the first embodiment according to the invention.
Figure 2:
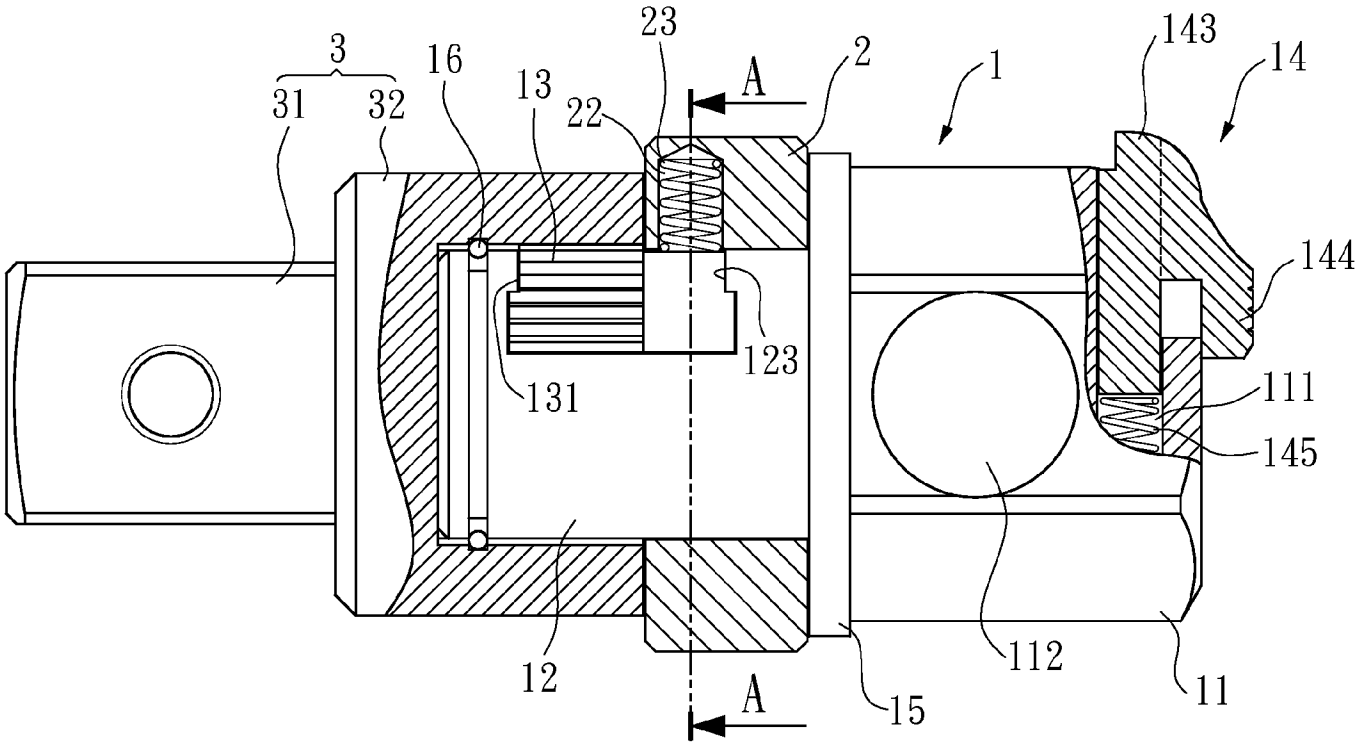
FIG. 2 is a cross-sectional view of the first embodiment.

The present invention will be apparent from the following detailed description, which proceeds with reference to the accompanying drawings, wherein the same references relate to the same elements.

Please refer to FIGS. 1 to 5 for a first embodiment of the disclosed ratchet connector, which includes a driving element 1, a control ring 2, and a working element 3.

The driving element 1 has a driving section 11 and an extending section 12. The driving section 11 is for a hand tool to connect and drive. The extending section 12 has an open groove 121 along its radial direction. Both sides of the open groove 121 have a sidewall 122, respectively. Each of the sidewalls 122 has a protruding part 123. Inside the open groove 121 is disposed with a tooth block 13. Both ends of the tooth block 13 have a concave part 131, respectively. The concave parts 131 of the tooth block 13 correspond to the protruding parts 123 of the sidewalls 122, respectively. Thus, the tooth block 13 is restricted to move along the bottom of the open groove 121. The end surface of the tooth block 13 opposite to the open groove 121 has a guiding surface 132 and an arc surface 133. Both sides of the arc surface 133 have several teeth 134, respectively. The guiding surface 132 is also an arc surface.

In the first embodiment, the driving section 11 of the driving element 1 is a hexagonal pillar. The driving section 11 can thus be combined with a box end wrench 4 or an open wrench. The end of the driving section 11 far from the extending section 12 has a radial groove 111 that is disposed with a positioning element 14. The positioning element 14 has a body 141, a positioning part 142, a stopping part 143, and a holding part 144. The stopping part 143 protrudes from the outer edge of the driving section 11. The positioning part 142 extends from the body 141 and close to the bottom of the stopping part 143 along the axial direction. It is disposed outside the end portion of the driving section 11. The positioning part 142 has the holding part 144. The holding part 144 is parallel to the body 141. The bottom of the positioning element 14 is disposed with a spring 145 to urge against the bottom of the body 141 of the positioning element 14. The holding part 144 depresses the spring 145 at the bottom of the positioning element 14. The stopping part 143 is disposed in the radial groove 111. Once the holding part 144 is released, the positioning element 14 is pushed by the spring 145 so that the stopping part 143 protrudes from the outer edge of the driving section 11. Using this method, the positioning element 14 positions one side of the box end wrench 4 or open wrench on the driving section 11.

Moreover, a protruding edge 15 is interposed between the driving section 11 and the extending section 12. The protruding edge 15 extends outwards from the peripheral of the driving element 1. The protruding edge 15 can stop the box end wrench 4 or open wrench far from one side of the positioning element 14.

The control ring 2 is mounted on the end of the extending section 12 close to the driving section 11 in the driving element 1. The control ring 2 has an inner ring surface 21, which has a blind hole 22 corresponding to the guiding surface 132 of the tooth block 13. The blind hole 22 is disposed with the elastic element 23. One end of the elastic element 23 urges against the guiding surface 132 for controlling the tooth block 13 to move along the bottom of the open groove 121.

The working element 3 has a working section 31 and a ratchet coupling section 32. The working section 31 is for connection with a working object, which is a mounting cylinder for example. The ratchet coupling section 32 is mounted on the extending section 12 of the driving element 1 and in the vicinity of one side of the control ring 2. The ratchet coupling section 32 has an annular inner surface 321 corresponding to the extending section 12. The inner surface 321 is annularly provided with a plurality of racket teeth 322. The curvature of the arc surface 133 on the tooth block 13 matches with that of the inner surface 321. The teeth 134 on the tooth block 13 are controlled to engage the ratchet teeth 322 on the inner surface 321.

Moreover, the extending section 12 of the driving element 1 is annularly disposed with a concave groove 124 near its end portion. The concave groove 124 is disposed with a C-shaped buckle 16. The inner surface 321 on the ratchet coupling section 32 of the working element 3 is formed with a ring groove 323. The ring groove 323 urges against the C-shaped buckle 16 of the extending section 12. The driving element 1 is thus positioned at the working element 3.

Besides, the driving section 11 has a radial through hole 112 for the insertion of a circular bar. The circular bar can drive the working object connected to the working section 31.

Figure 3:
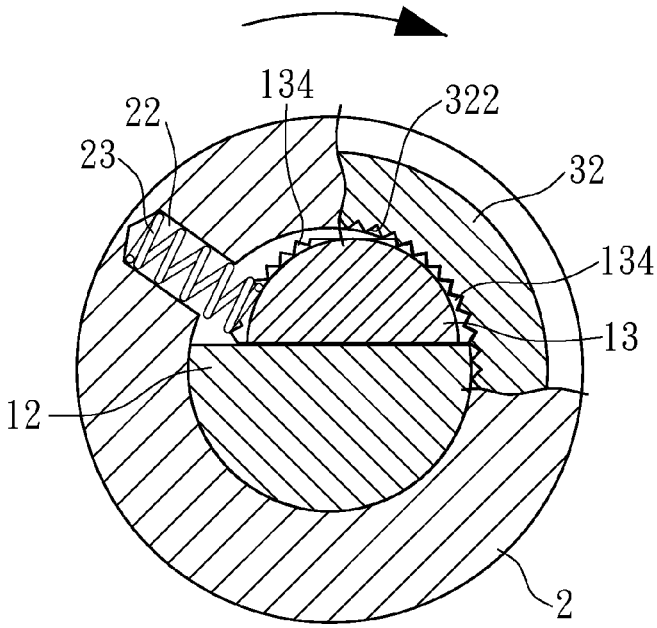
FIG. 3 is an A-A cross-sectional view of FIG. 2, showing forward driving.

Please refer to FIG. 3 in company with FIG. 1 for how it is used. The control ring 2 is in either a forward position or a reverse position, opposite to the working element 3. When the control ring 2 is rotated to the forward position, the elastic element 23 inside the blind hole 22 pushes the guiding surface 132 of the tooth block 13 using its one end. The tooth block 13 is restricted to move along the bottom of the open groove 121. The teeth 134 on one side of the tooth block 13 are retracted into the open groove 121, instead of touching the ratchet teeth 322 on the ratchet coupling section 32. The teeth 134 on the other side of the tooth block 13 protrude from the ratchet coupling section 32 of the working element 3. Using this method, the teeth 134 engage with the ratchet teeth 322. The ratchet teeth 322 of the ratchet coupling section 32 can only rotate in the forward direction, driving in a single direction.

Figure 4:
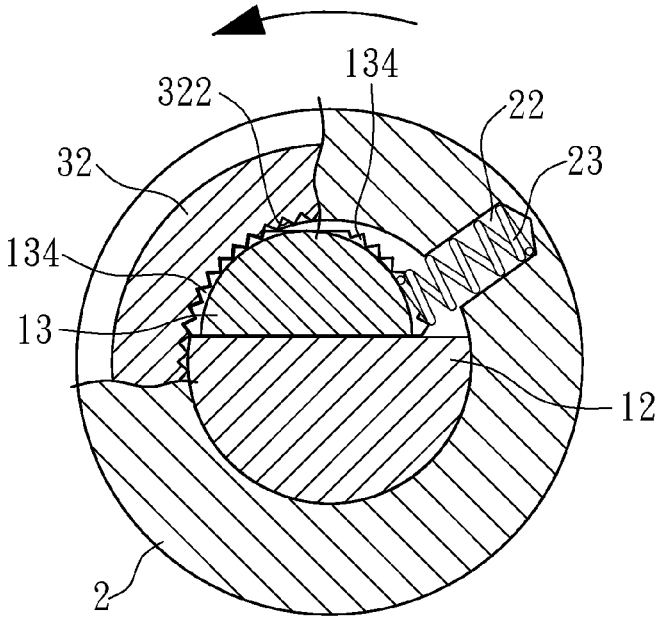
FIG. 4 is an A-A cross-sectional view of FIG. 2, showing reverse driving.

Please refer to FIG. 4 in company with FIG. 1. When the control ring 2 is in the reverse position, the elastic element 23 inside the blind hole 22 pushes the other side of the guiding surface 132 of the tooth block 13 using its one end. The tooth block 13 moves along the bottom of the open groove 121. The teeth 134 on one side of the tooth block 13 are retracted inside the open groove 121, instead of touching the ratchet teeth 322 on the ratchet coupling section 32. Besides, the teeth 134 on the other side of the tooth block 13 protrude from the ratchet coupling section 32 of the working element 3. Using this method, the teeth 134 engage with the ratchet teeth 322. The ratchet teeth 322 of the ratchet coupling section 32 can only rotate in the reverse direction, driving in a single direction.

Figure 5:
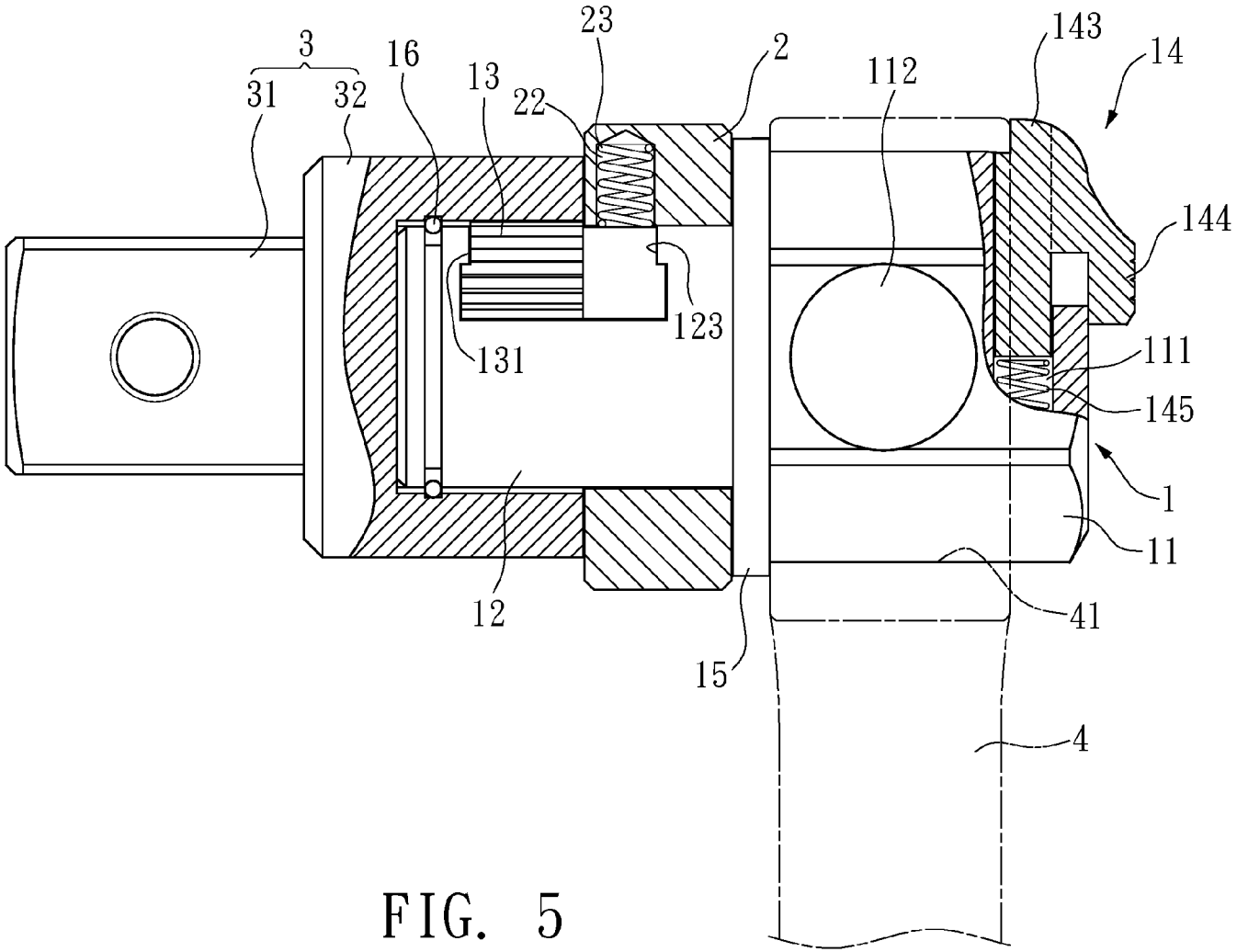
FIG. 5 is a schematic view showing the function of an anti-loose element in the first embodiment.

Please refer to FIG. 5 in company with FIG. 1. The holding part 144 of the positioning element 14 depresses the spring 145 at the bottom of the positioning element 14. The stopping part 143 is disposed in the radial groove 111. The mounting hole 41 of the box end wrench 4 is mounted on the driving section 11 of the driving element 1. One side of the box end wrench 4 is stopped at the protruding edge 15. When the holding part 144 is released, the stopping part 143 of the positioning element 14 protrudes from the outer edge of the driving section 11. The box end wrench 4 is positioned on the driving section 11 far from the side of the protruding edge 15. In this case, the box end wrench 4 can drive the working object connected to the working section 31 in the single direction.

Figure 7:
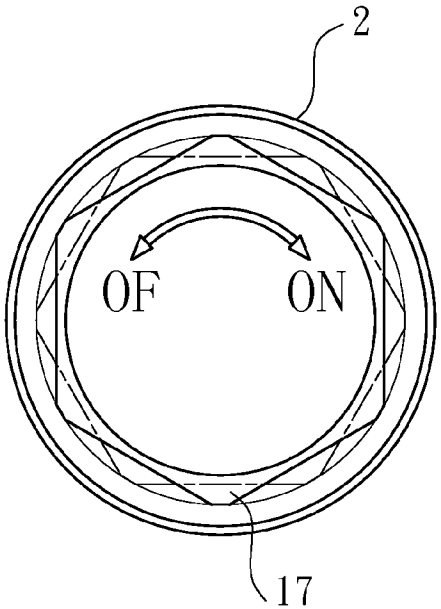
FIG. 7 is a side view of the second embodiment.
Figure 6:
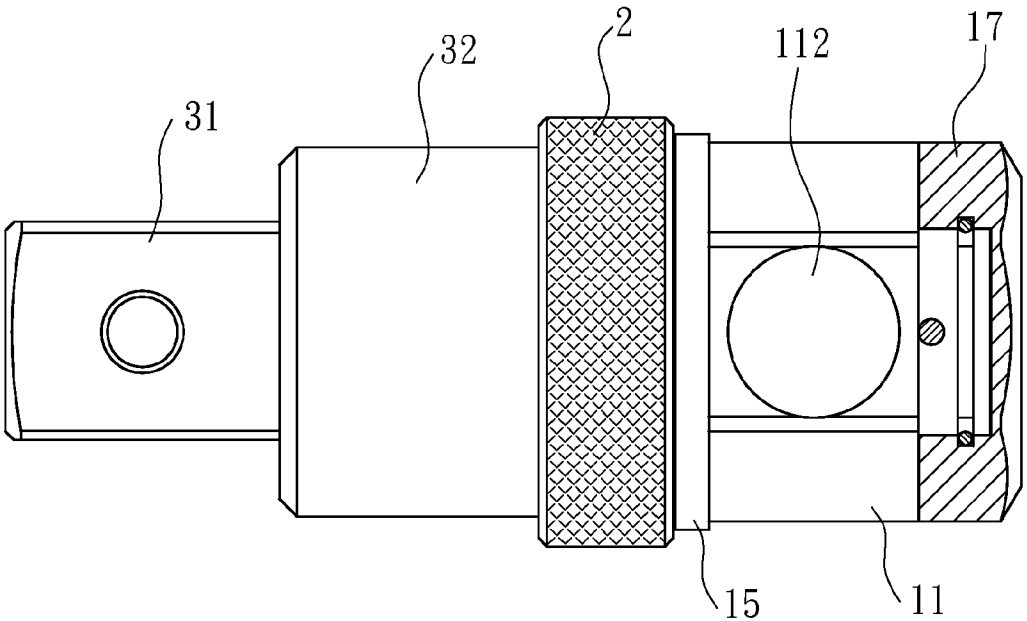
FIG. 6 is a cross-sectional view of the second embodiment.
Figure 8:
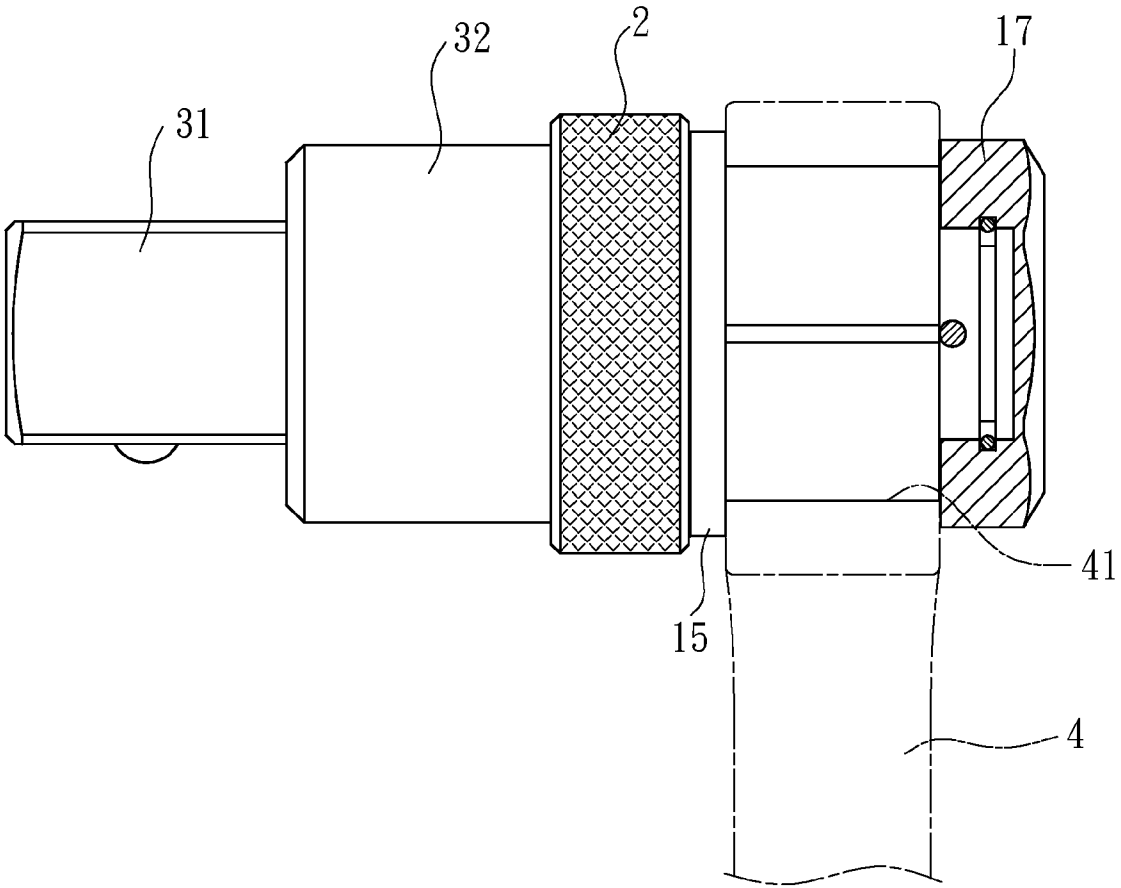
FIG. 8 is a schematic view showing the function of an anti-loose element in the second embodiment.

Of course, the invention has many other embodiments that only differ in details. Please refer to FIGS. 6 to 8 in company with FIG. 1 for a second embodiment according to the invention. It differs from the first embodiment in the positioning element 14 of the driving section 11. In the second embodiment, the end of the driving section 11 far from the extending section 12 is connected with a knob 17 in place of the positioning element 14 in the first embodiment. In this embodiment, the outer edge of the knob 17 forms a hexagon corresponding to the hexagonal pillar of the driving section 11.

According to the second embodiment, when the knob 17 is rotated in the same direction as the hexagonal outer edge of the driving section 11, the mounting hole 41 of the box end wrench 4 is mounted on the driving section 11 of the driving element 1. As a consequence, one side of the box end wrench 4 is stopped at the protruding edge 15. When the knob 17 is rotated in the opposite direction to the hexagonal outer edge of the driving section 11, the angles on the outer edge of the knob 17 prevent the box end wrench 4 from the side of the protruding edge 15. In this case, the box end wrench 4 is positioned at the driving section 11. Other operational details are the same as the first embodiment. Therefore, this embodiment can achieve the same effects as the first embodiment.

Figure 9:
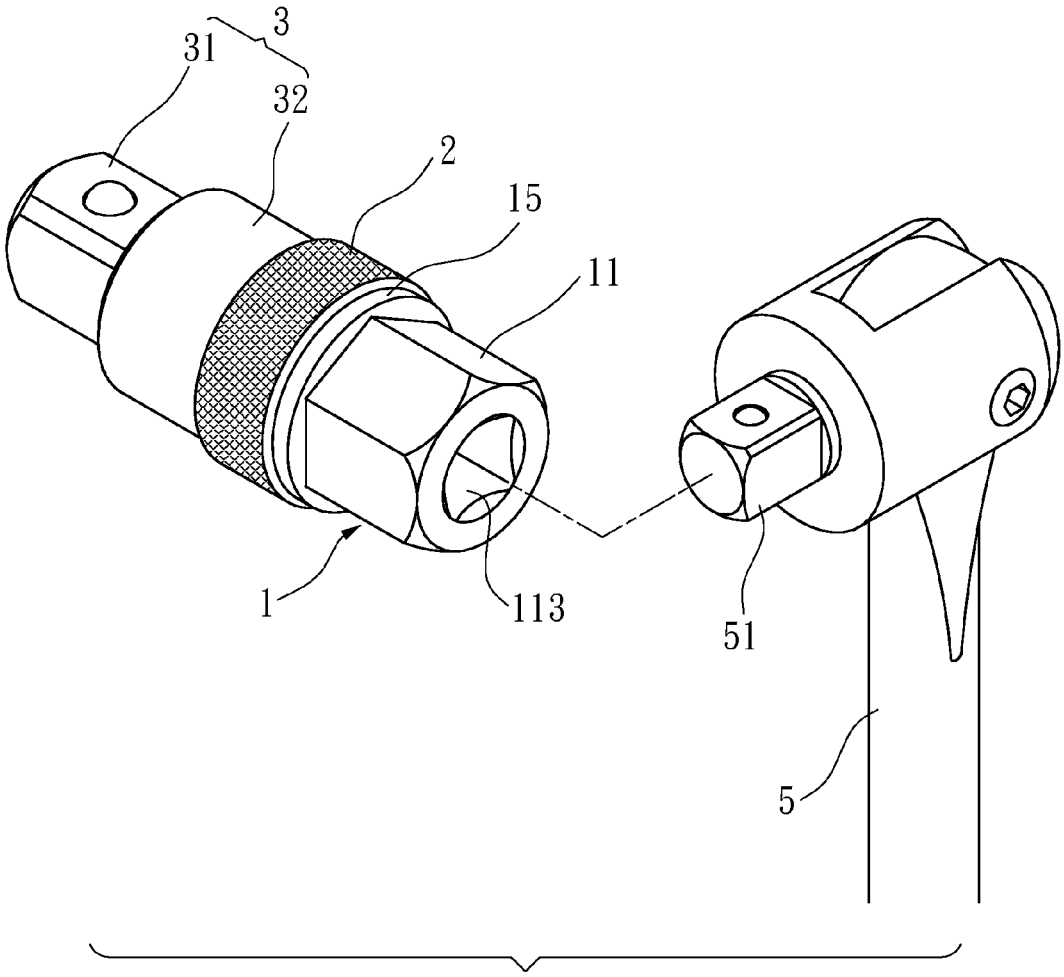
FIG. 9 is a three-dimensional exploded view of the third embodiment.

Please refer to FIG. 9 in company with FIG. 1 for a third embodiment of the invention. It differs from the first embodiment in that the driving section 11 of the driving element 1 has a square mounting hole 113 on the end far from the extending section 12. The mounting hole 113 can combine with a hand tool that has a square mounting head 51, such as an F-shaped wrench 5, thereby driving the working object connected to the working section 31. Other details are the same as the first embodiment. Therefore, same effects as the first embodiment can be achieved.

Figure 10:
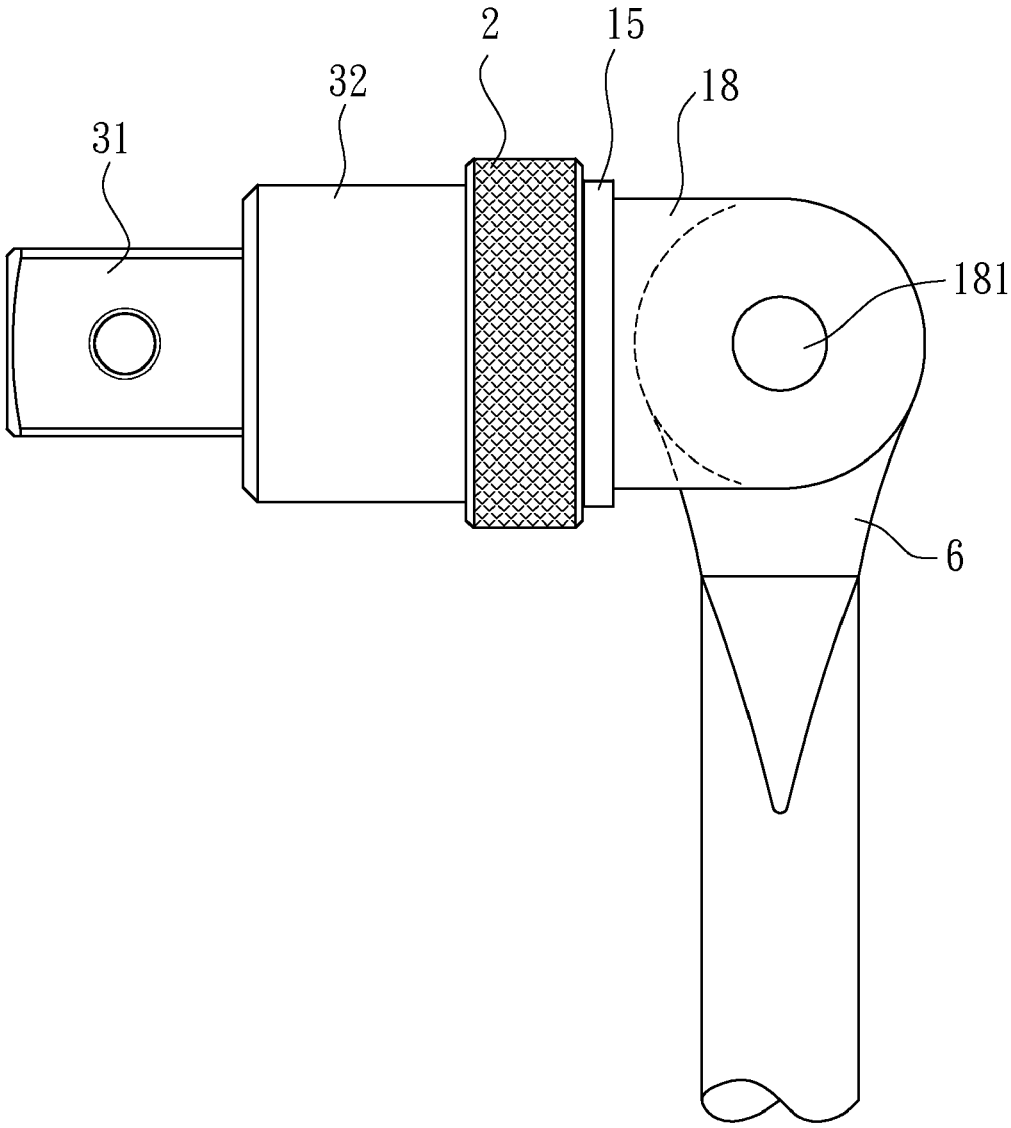
FIG. 10 is a cross-sectional view of the fourth embodiment.
Figure 11:
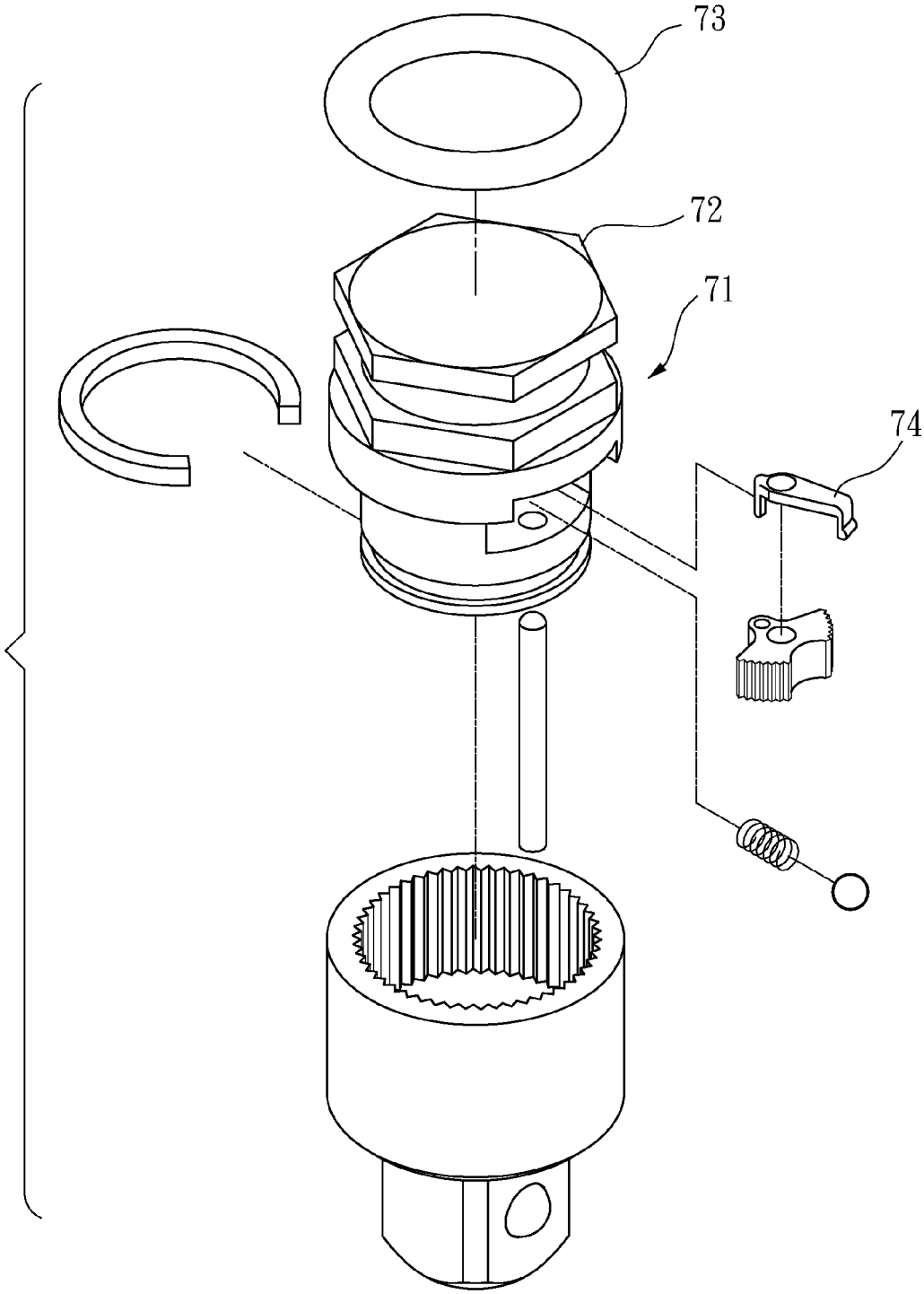
FIG. 11 PRIOR ART
FIG. 11 is a three-dimensional exploded view of a first conventional ratchet connector.
Figure 12:
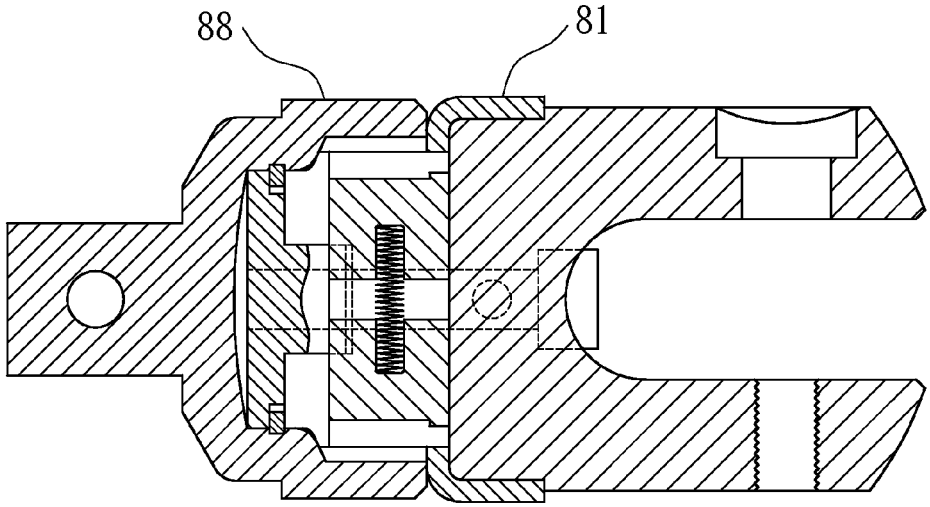
FIG. 12 PRIOR ART
FIG. 12 is a schematic view of a second ratchet connector.
Figure 13:
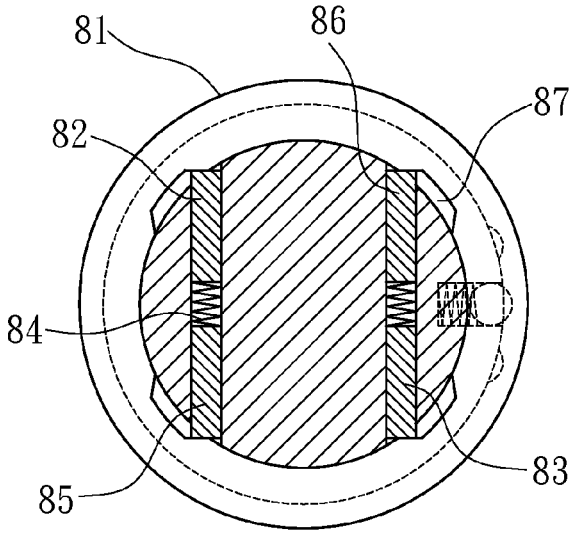
FIG. 13 PRIOR ART
FIG. 13 is a cross-sectional view of a second ratchet connector.
Figure 14:
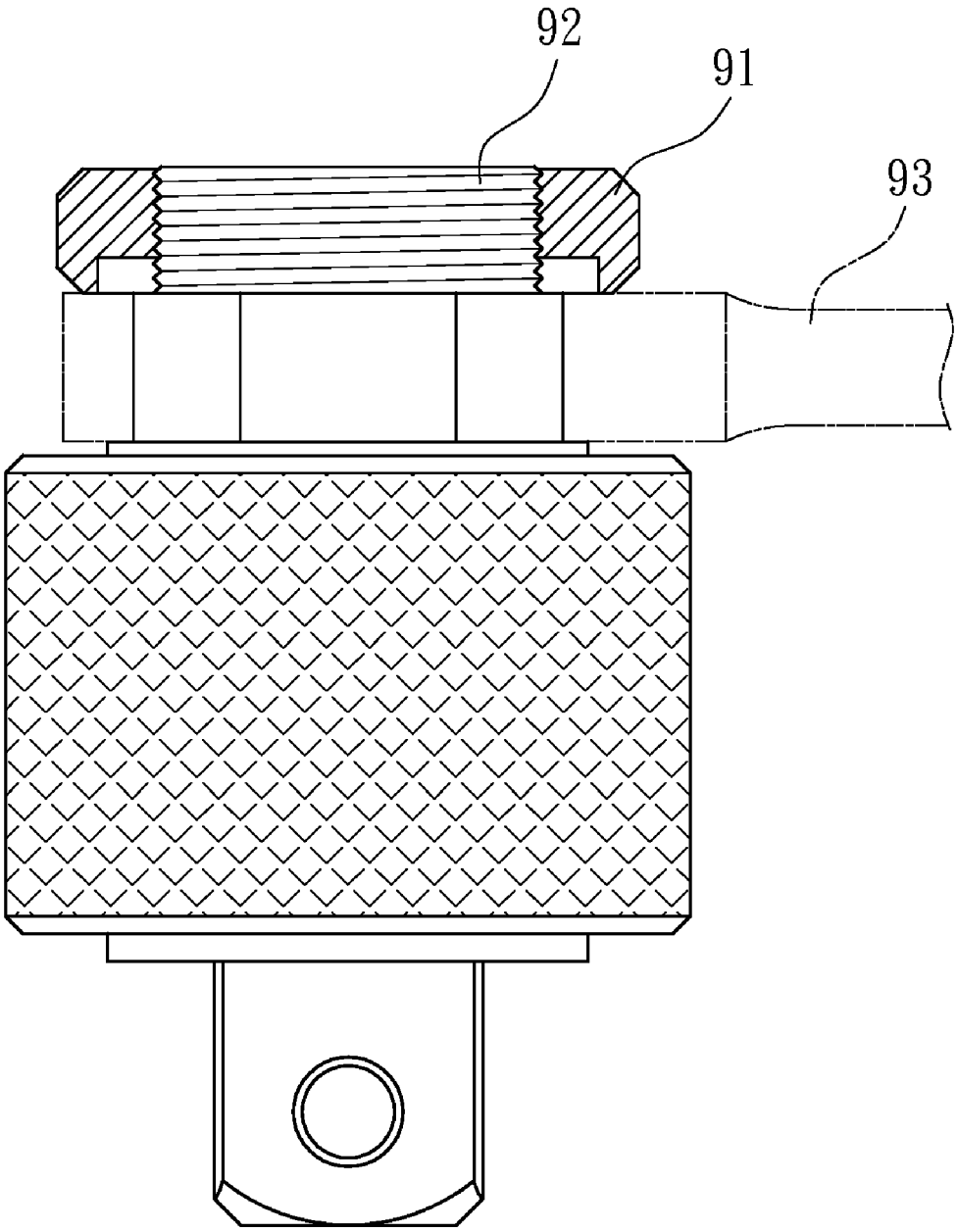
FIG. 14 PRIOR ART
FIG. 14 is a schematic view of a third ratchet connector.

Please refer to FIG. 10 in company with FIG. 1 for a fourth embodiment of the invention. It differs from the first embodiment in the driving section 11 of the driving element 1. In this embodiment, the driving section 11 of the driving element 1 uses two protruding ears 18 in place of the hexagonal pillar design in the first embodiment. Each of the protruding ears 18 has a hole 181. A connecting rod 6 is provided between the two protruding ears 18 and has a hole. Each of the holes 181 of the protruding ears 18 and the hole of the connecting rod 6 is inserted with a pin. Therefore, the driving section 11 connects to the connecting rod 6 and drives the working object connected to the working section 31. Other details are the same as the first embodiment. Therefore, same effects as the first embodiment can be achieved.

In summary, the disclosed ratchet connector uses the control ring 2 to conveniently change the driving direction. The elastic element 23 inside the control ring 2 urges against the guiding surface 132 of the tooth block 13 by one end. The user can smoothly operate the control ring 2. The control ring 2 also smoothly controls the tooth block 13 to move along the bottom of the open grove 121, achieving the function of single-direction driving. Besides, the invention has the advantages of simplifying the manufacturing process of conventional four-latch designs and reducing material costs, without sacrificing the feature of large torques. Moreover, the positioning element 14 or the knob 17 is disposed on the driving section 11 of the driving element 1. It can rapidly and firmly position hand tools such as the box end wrench 4 or open wrench. This increases convenience in use, work efficiency of the user, and competitive power of the invention on the market.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A ratchet connector comprising:

a driving element, which has a driving section for connecting to and driving a hand tool and an extending section, wherein the extending section has an open groove in the radial direction, both sides of the open groove have a sidewall, respectively, each of the sidewalls has a protruding part, the open groove is disposed with a tooth block whose both ends have a concave part, respectively, corresponding to the protruding parts of the sidewalls so that the tooth block is controlled to move along the bottom of the open groove, the end surface of the tooth block opposite to the open groove bottom has a guiding surface and an arc surface, and both sides of the arc surface have a plurality of teeth;

a control ring, which is mounted on the extending section of the driving element, in the vicinity of the driving section, wherein the control ring has an inner ring surface with a blind hole, the blind hole has an elastic element whose one end urges against the bottom of the blind hole and whose other end urges against the guiding surface of the tooth block, thereby controlling the tooth block to move along the bottom of the open groove; and a working element, which has a working section for the connection of a working object and a ratchet coupling section mounted on the extending section of the driving element and in the vicinity of the control ring, wherein the ratchet coupling section has an annular inner surface corresponding to the extending section, the inner surface has a plurality of ratchet teeth around it, and the curvature of the arc surface on the tooth block matches with that of the inner surface so that the teeth on the tooth block are controlled to engage the ratchet teeth on the inner surface.

2. The ratchet connector of claim 1, wherein the driving section of the driving element is a hexagonal pillar for the connection of a hand tool, such as the box end wrench or open wrench;

the end of the driving section far from the extending section has a radial groove disposed with a positioning element;

the positioning element has a body, a positioning part, a stopping part, and a holding part;

the stopping part protrudes from an outer edge of the driving section;

the positioning part extends in the axial direction from the body and close to the bottom of the stopping part and is disposed on the outer side of the end of the driving section;

the positioning part has the holding part parallel to the body;

the bottom of the positioning element is disposed with a spring to urge against the positioning element;

the holding part depresses the spring at the bottom of the positioning element;

the stopping part is disposed in the radial groove; and when the holding part is released, the positioning part is pushed by the spring so that the stopping part protrudes from the outer edge of the driving section.

3. The ratchet connector of claim 1, wherein the driving section of the driving element is a hexagonal pillar, the end of the driving section far from the extending section is pivotally connected with a knob, the outer edge of the knob is a hexagon corresponding to the hexagonal pillar of the driving section.

4. The ratchet connector of claim 1, wherein the driving section further has a radial through hole for the insertion of a circular bar to drive the working object connected to the working section.

5. The ratchet connector of claim 1, wherein the end of the driving section far from the extending section has a square mounting hole.

6. The ratchet connector of claim 1, wherein the driving section of the driving element includes two protruding ears, each of which has a hole, a connecting rod is provided between the two protruding ears and has a hole, the holes of the protruding ears and the connecting rod are inserted with pins so that the driving section connects to the connecting rod.

7. The ratchet connector of claim 1, wherein a protruding edge is interposed between the driving section and the extending section and extends from the side of the driving element outwards for stopping one side of the hand tool, such as the box end wrench or open wrench.

8. The ratchet connector of claim 1, wherein the extending section of the driving element is annularly formed with a concave groove near its end, the concave groove is provided with a C-shaped buckle, the inner surface of the ratchet coupling section on the working element is concavely formed with a ring groove, and the ring groove urges against the C-shaped buckle of the extending section so that the driving element is positioned on the working element.

* * * * *